US006276657B1

(12) United States Patent
Vappula

(10) Patent No.: US 6,276,657 B1
(45) Date of Patent: Aug. 21, 2001

(54) REMOVABLE SIDE WALL SYSTEM FOR A CASTING MOULD

(75) Inventor: Kari Vappula, Toijala (FI)

(73) Assignee: Addtek Research and Development Oy Ab, Nummela (SE)

( * ) Notice: Subject to any disclaimer, the term of this patent is extended or adjusted under 35 U.S.C. 154(b) by 0 days.

(21) Appl. No.: 09/274,480

(22) Filed: Mar. 23, 1999

(30) Foreign Application Priority Data

Mar. 27, 1998 (FI) ..... 980157 U

(51) Int. Cl.[7] ..... B28B 7/00

(52) U.S. Cl. ..... 249/163; 249/168; 249/139; 425/DIG. 33

(58) Field of Search ..... 249/139, 160, 249/163, 168; 425/3, DIG. 33

(56) References Cited

U.S. PATENT DOCUMENTS 3,154,833 * 11/1964 Kimball ..... 425/3
3,319,989 * 5/1967 Ross ..... 249/65.5
3,667,880 * 6/1972 Malet et al. ..... 249/219.1
5,277,396 * 1/1994 Vappula ..... 249/65
6,082,701 * 7/2000 Reymann ..... 249/160

FOREIGN PATENT DOCUMENTS

2907508 A * 9/1980 (DE) .
639686 A2 * 2/1995 (EP) .

* cited by examiner

*Primary Examiner*—Nam Nguyen
*Assistant Examiner*—Donald Heckenberg
(74) *Attorney, Agent, or Firm*—Burns, Doane, Swecker & Mathis, LLP

(57) ABSTRACT

A side wall system for a concrete casting mould, including a side part (1, 7) which is removably attachable to a casting bed by means of one or several magnets (11). The body (10) of the magnet part that carries the magnet (11) is provided with a gripping loop (14) or with a downwardly open gripping hook through which a release lever can be pushed in order to detach the magnet from the casting bed.

6 Claims, 3 Drawing Sheets

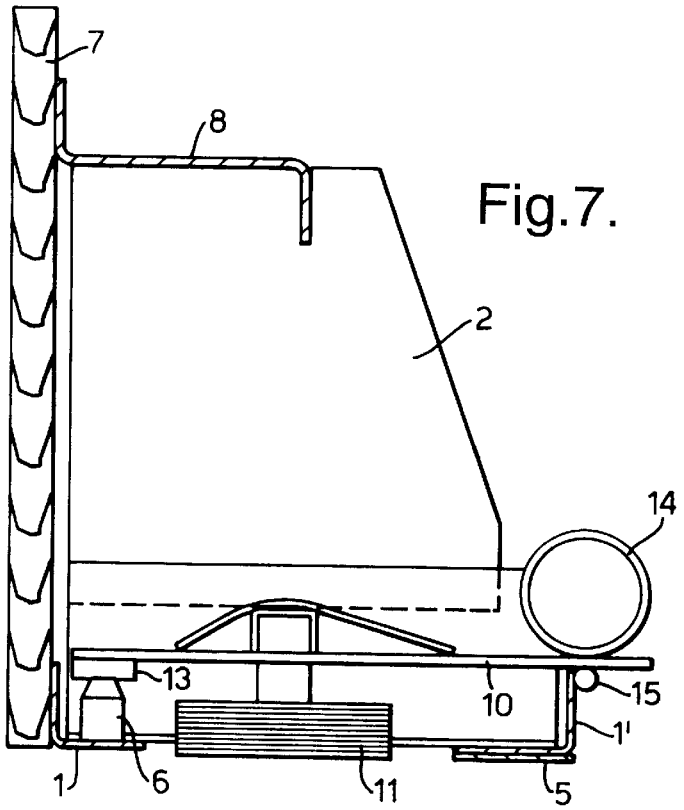
Fig.7.
Fig.8.
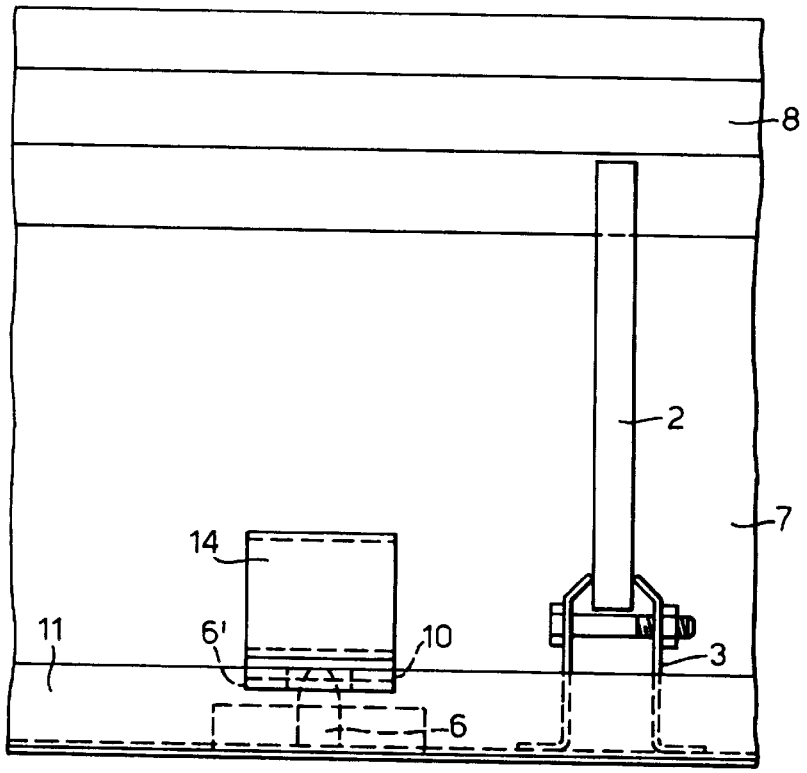

REMOVABLE SIDE WALL SYSTEM FOR A CASTING MOULD

TECHNICAL FIELD

This invention relates to a side wall system for a casting mould including a side part which is removably attachable to a casting bed by means of one or several magnets.

BACKGROUND ART

Removable sides which are provided with different kinds of fastener arrangements for a casting mould for elements to be cast from concrete have been disclosed in the prior art. These sides can be placed in desired positions on the casting bed, depending on the size and the shape of the piece to be cast.

Usually, when casting wall elements from concrete, a table mould, i.e. a tilt mould with side walls, is used as the horizontal mould. A casting machine moves above the table and applies a certain amount of mass into the mould. Once the concrete is hardened, the table is tilted about a tipping shaft provided on one side, almost into an upright position. That side wall of the mould that ends up in the upper position is removed and the element is lifted away from the table using loops provided on its sides. The position of the upper side wall has to be alterable according to the size of the element to be cast. Removable side walls can be used for this purpose.

Furthermore, removable and adjustable side parts enable door and window openings to be formed in desired places in the element.

Use of magnets for fastening of removable element sides is well known in the art. They are very suitable for the fastening of a side as they fasten to the smooth steel surface of the casting bed. In order to fasten the side tightly, strong magnets have to be used. However, removal of the magnets from the casting bed after casting may be quite difficult in some systems.

DISCLOSURE OF THE INVENTION

The side wall system according to the invention is characterized in that the body of the magnet part that carries the magnet comprises a gripping loop or a downwardly open gripping hook through which a release lever can be pushed in order to detach the magnet from the casting bed.

The invention provides a side wall system arrangement that can easily and quickly be modified in a normal factory workshop. The basic frame is formed by readily available steel and magnet parts ex stock, while the non-uniform casting and supporting parts are sawn from plywood locally. Assembly is easy and simple. The system is a suitable arrangement for side and opening moulds for all the present products of different thicknesses manufactured in the concrete industry.

The system according to the invention can be composed of three standard components ex stock, i.e. of a lower side wall frame, of a supporting profile for the upper edge of the side wall and of a fastening magnet. In addition, the system includes mould and support panels made of plywood. They are made separately for each case locally.

The entity formed by a side and a magnet according to the invention is light, compact and easy to use. Besides, is does not take much time to construct it. The side can be fastened and removed easily and quickly. The system is simple and reliable.

BRIEF DESCRIPTION OF FIGURES

The invention and the details thereof will now be described in detail with reference to the accompanying figures wherein FIG. 7 shows the side construction and the magnet part viewed from end of the side, and FIG. 8 shows the side wall structure viewed from the side of the side wall.

MODE FOR CARRYING OUT THE INVENTION

Figure 6:
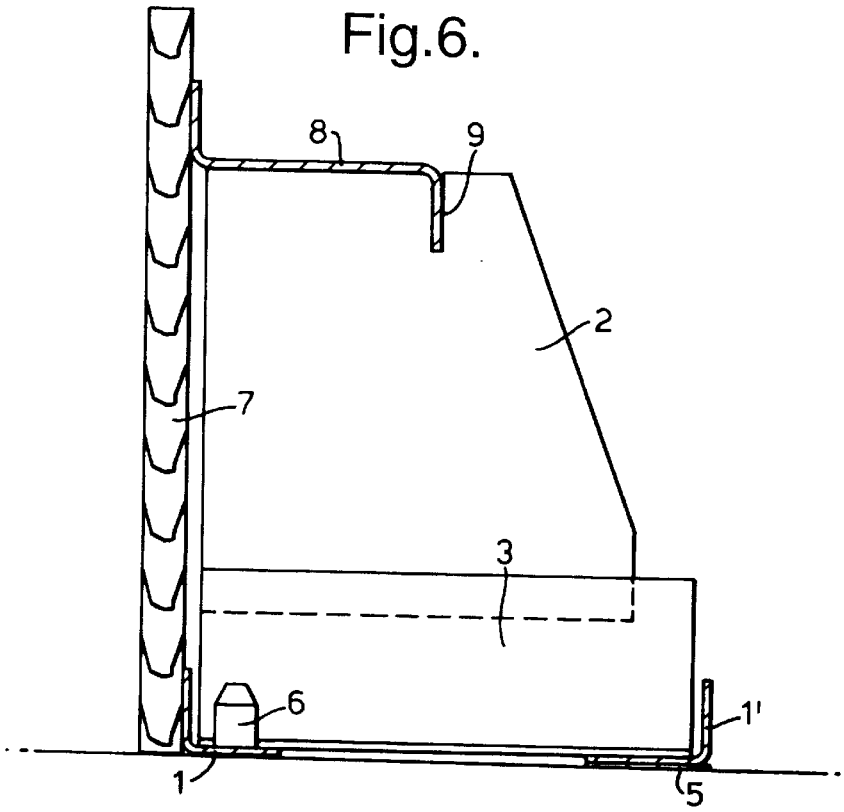
FIG. 6 shows the side wall structure assembled and viewed from the end of the side.

The side structure includes a lower frame consisting of two adjacent L-profiles 1, 1', for example. The function of the frame is to stiffen the lower edge of the structure, to serve as a base to which the magnet can fasten and to attach vertical stiffeners. The vertical stiffeners 2 (FIGS. 6 and 7) are made of plywood and each of them is arranged between two transversal pressure plates 3 of metal fixed to the lower frame. The upper edges of the pressure plates are bent towards each other, and the distance between the pressure plates can be adjusted by means of tightening screws 4.

Rubber pieces 5 that hold the side part in place are provided under that profile 1' of the frame of the side that lies further back, i.e. lies at a longer distance from the side wall. The front profile 1 is provided with vertical pins 6 with a spacing of about 1–1.5 meters from the fastening of the magnets. The rear profile 1' is provided with correspondingly located cutouts 6' in the vertical flange of the profile. The side wall 7 is made of plywood and it is provided with an angular profile bar 8 fixed to its upper edge and supported in Grooves 9 in the vertical stiffeners 2.

A side structure like this is easy to manufacture accurately dimensioned. It results in light and strong arrangements and in an arrangement which as a whole is as narrow as possible. The side structure allows the magnet to be removed in the middle of the process.

Figure 1:
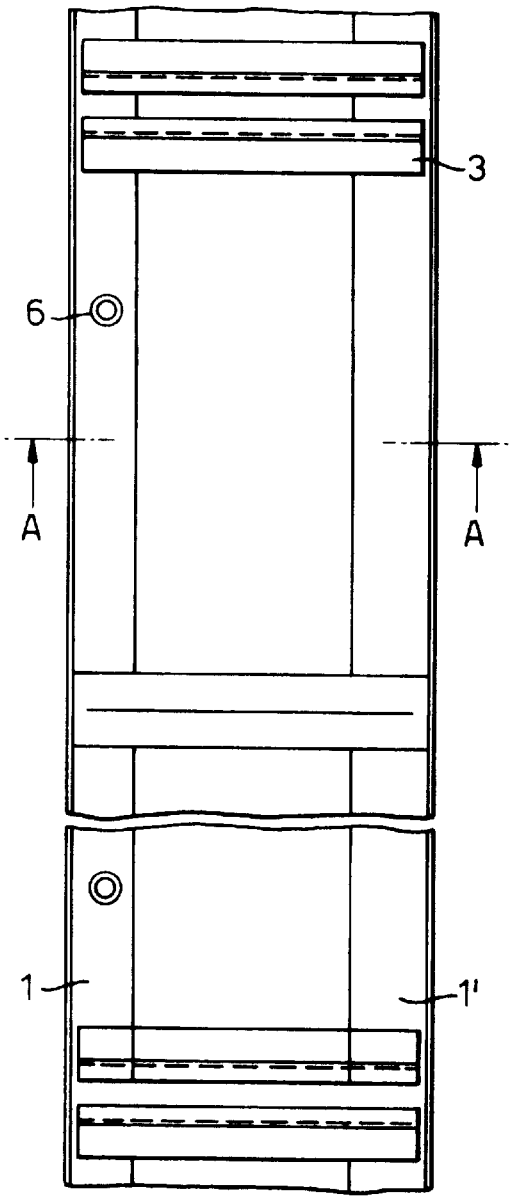
FIG. 1 shows the lower frame of the side wall of a system according to the invention viewed from above.
Figure 2:
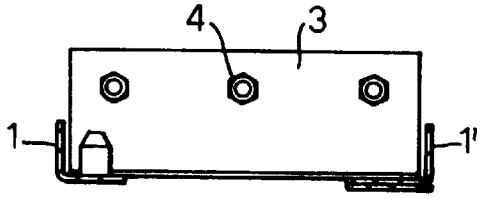
FIG. 2 is a cross-sectional view of the pressure plates of the lower frame taken along line A—A of FIG. 1.
Figure 3:
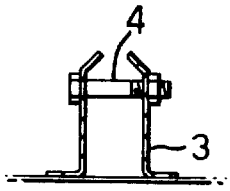
FIG. 3 shows the pressure plates according to FIG. 2, viewed from the side of the side wall.
Figure 4:
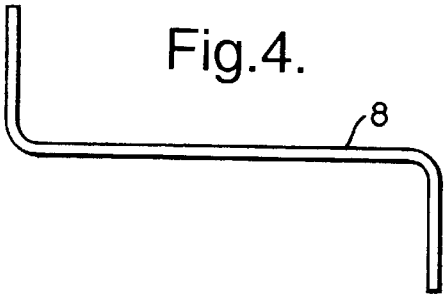
FIG. 4 shows a supporting profile for the upper edge of the side wall.
Figure 5:
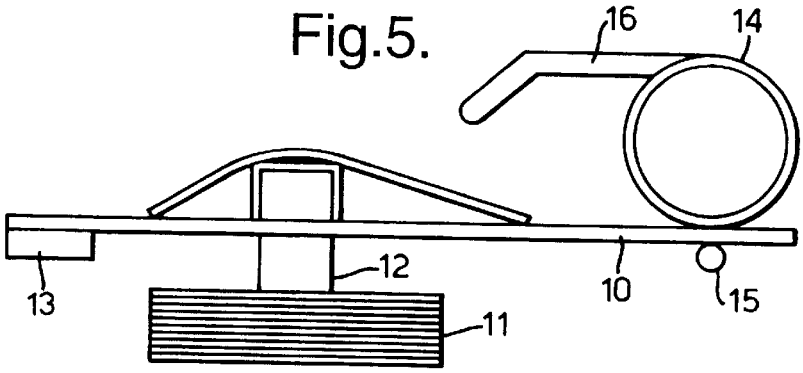
FIG. 5 shows a magnet part.

The fastening magnet is a separate magnet assembly that is easy to fasten and to remove from the side wall and from the casting bed. The magnet part includes a body 10 and a permanent magnet 11 (FIG. 5). The magnet is fixed to the body by means of an adjustable screw 12 that enables the magnet to be adjusted in height so that the side is securely fitting and tight in its entirety.

The front end of the body 10 of the magnet part, i.e. the end lying nearer to the side wall 7, the lower surface of the body, is provided with a cylindrical, downwardly open guiding piece 13 capable of receiving the pin 6 of the frame of the side part. The rear end of the body 10 fits into the cut-out 6' in the vertical flange of the profile 1' incorporated in the frame of the side. A release loop 14 is provided at the rear end of the body 10. It is possible to arrange an aligning rod 15 on the underside of the body, under the loop, to ensure that the magnet is properly aligned laterally. The upper part of the release loop can also be provided with a handle 16 by means of which it is possible to get a good grip on the magnet part at the setting stage.

The magnet is fastened to the side wall and to the casting bed by arranging the guiding piece 13 of the magnet body on the pin 6 of the front profile of the lower frame of the side and by laying the rear end of the magnet body on the rear profile 1' of the lower frame. The rear end of the body is arranged into the cut-out in the profile 1'. If the magnet is correctly adjusted, the magnet 11 fastens to the casting bed between the profiles 1, 1' of the lower frame. The ends of the magnet body 10 press the profiles downwards and press the side tightly against the casting bed.

The side is detached from the casting bed by means of a hand lever that is easy to use. The lever can be any kind of a bar or a pipe of the right size. The lever is a light hand lever that is easy to use. The lever is pushed through the release loop 14 and the magnet is turned laterally by means of the lever. The magnet comes off the casting bed whereas the magnet part fastens to the hand lever. The magnet can be removed already at the initial stage of the casting bed cycle and used in the following castings.

The magnet is light and it is easy to handle and adjust. The whole adhering force of the magnet, 14 kN, for example, is optimized to keep the side attached.

The invention is not restricted to the embodiment described above. Variations and modifications exist which are within the scope of the present invention as defined in the following claims. The gripping loop does not have to be a closed loop, it can also be a hooked, downwards open piece under which the release lever can be arranged. The axis of the loop or hook can be either parallel to the side wall or perpendicular to the side wall, the loop being located on the side of the magnet body.

What is claimed is:

1. A side wall system for a concrete casting mould defining a casting bed, said system comprising:

a side structure removably attachable to the casting bed by one or more magnet assemblies; said side structure including a side wall, a front profile proximate to said side wall and a rear profile distal thereto, said side structure further including a pin extending from said front profile;

wherein each said magnet assembly includes a body part and a magnet part, said body part having a front end and a rear end and said magnet part being fixed to said body part between said front and rear ends;

wherein said front end of said magnet body includes a guide piece which engages said pin of said side structure and said rear end of said magnet body engages said rear profile of said side structure; and a gripping member for receiving a release lever and detaching said magnet part from the casting bed.

2. A side wall system as defined in claim 1, wherein the axis of the gripping member is parallel to the side wall.

3. A side wall system as defined in claim 1, wherein said guide piece includes a cylinder for receiving the pin.

4. A side wall system as defined in claim 1, wherein the rear profile has guide surfaces between which the body part of the magnet assembly is received.

5. A side wall system as defined in claim 2, wherein said guide piece includes a cylinder for receiving the pin.

6. A side wall system as defined in claim 3, wherein the rear profile has guide surfaces between which the body part of the magnet assembly fits.

* * * * *